United States Patent [19]

Alquist et al.

[11] 4,229,281

[45] Oct. 21, 1980

[54] PROCESS FOR EXTRACTING BITUMEN FROM TAR SANDS

[75] Inventors: Henry E. Alquist, Bartlesville, Okla.; Allen M. Ammerman, McPherson, Kans.

[73] Assignee: Phillips Petroleum Company, Bartlesville, Okla.

[21] Appl. No.: 933,346

[22] Filed: Aug. 14, 1978

[51] Int. Cl.[2] ..... C10G 1/00

[52] U.S. Cl. ..... 208/11 LE

[58] Field of Search ..... 208/11 LE

[56] References Cited

U.S. PATENT DOCUMENTS

| | | | |
|---|---|---|---|
| 2,825,677 | 3/1958 | Coulson | 208/11 LE |
| 3,117,922 | 1/1964 | Leary et al. | 208/11 LE |
| 3,330,757 | 7/1967 | Bichard | 208/11 LE |
| 3,422,000 | 1/1969 | Bichard | 208/11 LE |
| 3,459,653 | 8/1969 | Benson | 208/11 LE |
| 3,547,803 | 12/1970 | Barkman et al. | 208/11 LE |
| 4,017,377 | 4/1977 | Fairbanks et al. | 208/11 LE |

OTHER PUBLICATIONS

"Encyclopedia of Chem. Tech.", vol. 19, Kirk-Othmer, pp. 544–566, (1969).

Surface-Active Agents, Rohm & Haas, pp. 1–7, (1968).

*Primary Examiner*—Delbert E. Gantz

*Assistant Examiner*—Joseph A. Boska

[57] ABSTRACT

Bitumen is recovered from tar sand by extraction with a solvent. The bitumen solution is washed with water containing a cationic surfactant in order to remove sand fines therefrom.

7 Claims, 1 Drawing Figure

PROCESS FOR EXTRACTING BITUMEN FROM TAR SANDS

BACKGROUND OF THE INVENTION

This invention relates to a method for removing bitumen from tar sands. In another aspect, this invention relates to a method for removing bitumen from tar sands by solvent extraction. In another aspect, this invention relates to a method of removing bitumen from tar sands by extraction with an aromatic hydrocarbon solvent. In still another aspect, this invention relates to the removal of sand fines from a solvent-bitumen extract. In still another aspect, this invention relates to the removal of sand fines from a solvent-bitumen extract by washing said extract with water containing a cationic surfactant. In still another aspect, this invention relates to a method of removing bitumen from tar sands by solvent extraction wherein sand fines are removed from the solvent-bitumen extract by washing with water containing a cationic surfactant.

Various methods have been proposed in the past for the recovery of bitumen from tar sands. One such method utilizes the technique of solvent extraction. A serious problem, however, in using a solvent extraction process to remove bitumen from tar sands is that sand fines, primarily particles less than 50 microns in diameter, are carried over in the solvent-bitumen extract. The presence of the sand fines and the failure to remove the sand fines result in a high-ash bitumen product as well as problems with plugging of equipment used in the separation process, e.g., especially filtration equipment. Removal of the sand fines is, therefore, important in providing a desirable low-ash bitumen product and minimizing fouling and plugging of equipment used in the process.

Various methods have been proposed to solve the problem caused by the presence of the sand fines. The results are not entirely satisfactory, however, as far as economics and practicality are concerned.

U.S. Pat. No. 3,117,922 discloses a method in which tar sand and solvent are generally slurried so as not to break the water film that is thought to surround the fine sand particles. This process requires a multi-solvent system, however, and would not be practical for tar sands in which the water had previously been removed or dried out.

Other methods have proposed an elaborate system of staged cyclones, centrifuges, and vacuum filters. After removal of coarse sand from a bitumen-solvent solution, if one attempts to filter the bitumen-solvent extract without centrifuging, the filter is blocked immediately due to the fine sands present in the solution. Even after extensive centrifuging and filtration, however, the bitumen-solvent solution still contains fine sands which amount to about 0.5 to 1.0 weight percent of the dissolved bitumen. Furthermore, an elaborate system of cyclones, centrifuges, and vacuum filters is extremely expensive to buy and operate.

U.S. Pat. No. 3,459,653 discloses a process for removing tar from tar sands which comprises slurrying the tar sands and the solvent in the presence of an added amount of water followed by filtration of the slurry and recovery of the solvent from the sand bed. A water wash of the decanted bitumen-solvent solution will permit filtration as disclosed in U.S. Pat. No. 3,459,653, but, this wash will require at least one-half gallon of water per gallon of recovered bitumen. This would cause problems in recovering bitumen since the fines and bitumen residuals would be thoroughly suspended in the water thus resulting in an undesirable, high-ash bitumen product. The process also consumes a great deal of water.

Accordingly, one object of this invention is to provide an improved process for the recovery of bitumen using solvent extraction.

Another object of this invention is to provide a process for recovering a low-ash bitumen product.

Yet another object of this invention is to provide a process for the recovery of bitumen from tar sands in which fouling and plugging of equipment used in the process is minimized.

Another object of this invention is to provide a process for the recovery of bitumen which reduces water consumption and has little solvent loss.

Other objects, aspects, and the several advantages of this invention will be apparent to those skilled in the art upon a study of this disclosure, the appended claims, and the drawing.

SUMMARY OF THE INVENTION

This invention relates to an improved process for the recovery of bitumen using solvent extraction. The process comprises contacting the bitumen solution with water containing a cationic surfactant. In a preferred embodiment of this invention, tar sands from which the bitumen is to be extracted is mixed with an extractive solvent. This mixture is allowed to settle into a fine sand-bitumen-solvent phase and a coarse sand phase. The fine sand-bitumen-solvent phase is then removed, which can be accomplished by decanting, and then contacted with water containing a cationic surfactant. The mixture of the bitumen solution and the water wash containing the cationic surfactant is then allowed to settle into a solvent phase, an interface zone where sand fines collect, and an aqueous phase. The solvent phase is then removed and separated into solvent and a low-ash bitumen product. Separate removal of the interface phase containing the sand fines and the aqueous phase can also be effected with recycle of the aqueous phase.

BRIEF DESCRIPTION OF THE DRAWING

The FIGURE illustrates schematically an embodiment of the invention.

DETAILED DESCRIPTION OF THE DRAWING

Figure 1:
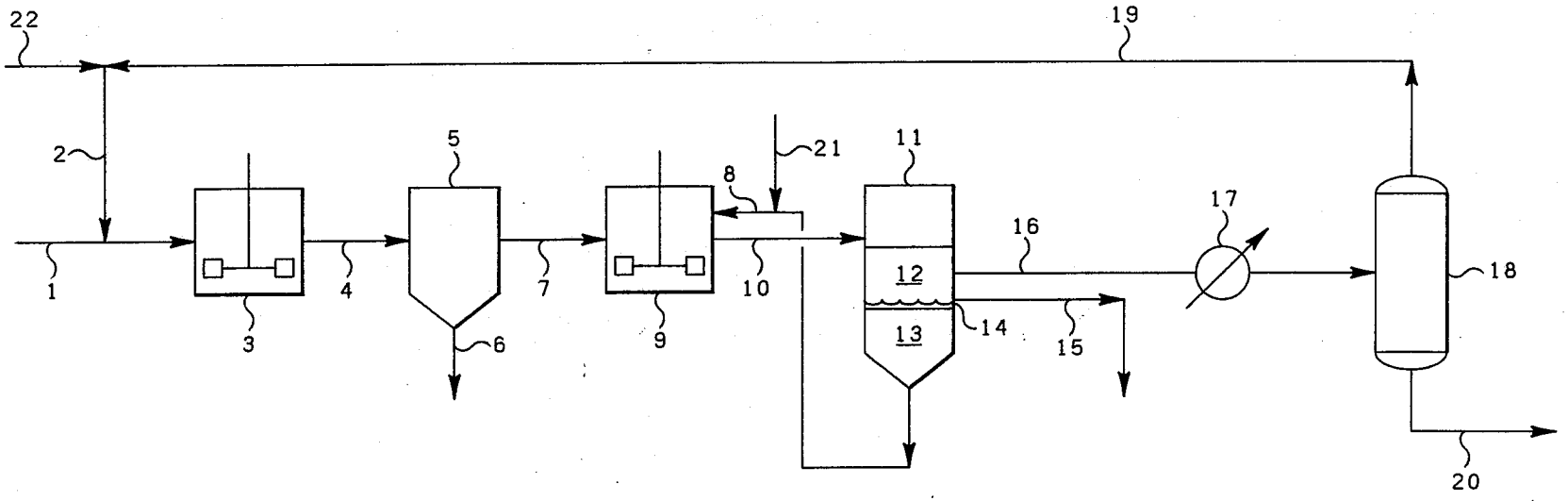

A major problem in the solvent extraction of bitumen from tar sands is the removal of sand fines. The removal of the sand fines is important in providing a low-ash bitumen product and in minimizing fouling and plugging of equipment used in the process. The instant invention comprises contacting bitumen solution with water containing a cationic surfactant in order to effect the removal of sand fines.

Bituminous sand, or tar sand, is extracted with a suitable solvent. The mixture is allowed to settle and is separated, for example, by decantation, in order to remove coarse sand from bitumen solution which usually contains at least 0.5–1.0 weight percent solids based on bitumen content. When this bitumen solution is contacted with water containing a cationic surfactant, the coarse fines will concentrate in a float layer between clear water and the solvent-bitumen extract. This allows for removal of bitumen solution containing only about 0.2–0.4 weight percent sand fines or ash, based on weight of bitumen, without any filtration since the fines have concentrated themselves at the solvent-water interface zone that can be taken off by a weir. The interface zone, as an example, can contain about 14 percent fines and less than one percent bitumen. Most of the water or aqueous layer is reasonably clear and can be reused. The separated bitumen solution or solvent phase can be conventionally treated to recover solvent, e.g., flashing or distillation.

While the upper and lower concentrations of cationic surfactant are dictated by the particular reagent chosen, the limits are also dictated by a balance of two factors. The lower concentration of cationic reagent is dictated by the amount required to wet and extract fines from the solvent phase and then float these fines between the water and solvent layer. The lower concentration, therefore, depends upon the specific cationic agent chosen and the specifics of the contacting hardware. On the other hand, if too much cationic surfactant is used, the emulsion will become so tight that the system will not break into three layers. Generally, a weight percent of 0.01 to 0.10 of the cationic surfactant in the water wash is an appropriate concentration.

In practicing the invention, solvents useful in the extraction step include aromatic hydrocarbons, naphtha, gasoline, or other hydrocarbons boiling below about 230° C. Although the hydrocarbon solvent of the instant invention can be aromatic, naphthenic or paraffinic in character, an aromatic solvent or a highly aromatic solvent mixture is preferred since the bitumens are generally more soluble in aromatic hydrocarbons than in other, more saturated hydrocarbons. Examples of preferred aromatic solvents are xylene and toluene.

The extraction, settling, and contacting steps can be carried out at any temperature and at sufficient pressure to prevent vaporization of the solvent or water. Generally, a temperature in the range of about 5° C. to 40° C. is appropriate.

Any cationic surfactant can be used in the invention, including the four classes discussed in *Encyclopedia of Chemical Technology,* Second Edition, Vol. 19, pp. 554–566:

(1) Amines not containing oxygen,
(2) Oxygen-containing amines, except amides,
(3) Amines having amide linkages, and
(4) Quaternary salts.

It is the use of the cationic surfactant which effectuates the removal of the sand fines, thereby the use of an anionic or nonionic surfactant as disclosed in U.S. Pat. Nos. 4,017,377; 3,547,803; and 3,330,757 is not appropriate for the process of the instant invention. The anionic and nonionic surfactants are surprisingly not nearly as effective as the cationic surfactant for removing the sand fines and thereby are not as economically or practically desirable for use as is a cationic surfactant.

A better understanding of the invention will be obtained upon reference to the drawing. The following embodiments are not intended to limit the invention in any way and are only given for illustration.

Referring now to the FIGURE, the FIGURE illustrates schematically the process of the invention which may be carried out either batchwise or continuously. Tar sand in line 1, essentially free of lumps, is combined with a suitable solvent, e.g., toluene, via line 2 and thoroughly mixed in mixing zone 3 which can be any device suitable for mixing and contacting solids with a liquid such as an agitated tank or in-line mixer. The sand-solvent slurry passes via line 4 to settling zone 5 from which coarse sand is withdrawn via line 6 and bitumen solution containing sand fines via line 7. This bitumen solution is contacted with an aqueous solution of a cationic surfactant entering from line 8 in contacting zone 9 which can be any suitable device for liquid-liquid contacting such as an agitated vessel, in-line mixer, packed tower or the like. After contacting, the mixture passes via line 10 to settler 11 where the mixture separates into a low-ash bitumen solution phase 12, an aqueous phase 13, and an interface zone 14 where the fines collect and are withdrawn via line 15 for disposal or further treatment such as centrifugation or further washing. The bitumen solution is withdrawn via line 16, preheated in 17 and separated in zone 18 into recycle solvent stream 19 and bitumen product 20. Separation zone 18 can consist of one or more flash steps, steam stripping, fractionation or the like. In this step it may be desirable to dilute the bitumen with a high boiling solvent (not shown) such as a heavy aromatic, cracked or hydrocracked bitumen or the like to reduce the viscosity of the bitumen during solvent recovery. Makeup surfactant solution can be supplied by line 21 and makeup solvent by line 22. Coarse sand removed from settling zone 5 via line 6 can be treated by methods known in the art to recover residual solvent.

The effectiveness of cationic surfactants over other surfactants has been demonstrated in the laboratory and is shown in the following example.

EXAMPLE

A series of tests were made using tar sand from the Edna District of California. In each room-temperature test, 30 g of tar sand was agitated with 30 g of toluene solvent for 30 seconds and the mixture allowed to settle for five minutes. The solution was decanted from the settled sand and added to 30 ml of distilled water containing surfactant, if any. Bitumen extract and water were vigorously shaken for 30 seconds, allowed to settle for five minutes, and the decant filtered through fresh filter paper. Filtering time for 9 ml of filtrate was recorded as a measure of fines removal.

| Surfactant* | Surfactant Concentration, g/30 ml | Filtration Time, Min.** |
|---|---|---|
| None | — | 32.0 |
| Anionic | 0.030 | 34.4 |
| " | 0.090 | 37.3 |
| " | 0.125 | 14.7 |
| Nonionic | 0.030 | 18.7 |
| " | 0.100 | 9.7 |
| " | 0.204 | 9.6 |
| Cationic | 0.0025 | 15.4 |
| " | 0.015 | 1.7 |
| " | 0.025 | 2.4 |
| " | 0.060 | 3.1 |

*Anionic surfactant was Vinsol NVX, a neutralized rosin resin manufactured by Hercules, Inc.
Nonionic surfactant was Triton X-305, an alkylaryl polyether alcohol manufactured by Rohm & Haas.
Cationic surfactant was Hyamine 2389, a blend of methyldodecylbenzyl trimethyl ammonium chloride and methyldodecylxylylene-bis-(trimethyl ammonium chloride) manufactured by Rohm & Haas.
**Time for 9 ml of filtrate through filter paper.

The results show the surprisingly superior effectiveness of cationic surfactants over anionic and nonionic surfactants for aiding in the removal of sand fines. The use of water containing a cationic surfactant for contacting a bitumen-solvent extract, therefore, solves the problem of sand fines removal more effectively than either the use of anionic or nonionic surfactants.

Reasonable variations and modifications can be made in the present invention without departing from the spirit and scope thereof.

We claim:

1. A process for recovering bitumen from tar sands wherein bitumen is extracted from the tar sands with a solvent which process comprises contacting the bitumen solution comprising said solvent, bitumen and sand fines with water containing about 0.01 to about 0.10 weight percent of a cationic surfactant to effect the removal of said sand fines from said bitumen solution, recovering the resulting bitumen solution thereafter and recovering bitumen from said bitumen solution.

2. A process in accordance with claim 1 wherein said cationic surfactant comprises 80 percent methyldodecylbenzyl trimethylammonium chloride and 20 percent methyldodecylxylylene-bis-(trimethylammonium chloride).

3. A process in accordance with claim 1 wherein said solvent is an aromatic hydrocarbon solvent.

4. A process for recovering bitumen from tar sands comprising the steps of:

(a) mixing the tar sands with an extractive solvent, (b) allowing the mixture of step (a) to settle into a fine sand-bitumen solvent phase and a coarse sand phase, (c) removing the fine sand-bitumen solvent phase, (d) contacting said fine sand-bitumen solvent phase with water containing a cationic surfactant wherein the amount of said cationic surfactant present in the water is the range of about 0.01 to about 0.10 weight percent and allowing the mixture to settle into a solvent phase, an interface zone where the fines collect, and an aqueous phase, and (e) removing the solvent phase and separating said phase into solvent and bitumen product.

5. A process in accordance with claim 4 which further comprises diluting the solvent phase to be separated into solvent and bitumen product prior to said separation with a high boiling solvent in order to reduce the viscosity of the bitumen during solvent recovery.

6. A process in accordance with claim 4 wherein said solvent is an aromatic hydrocarbon solvent.

7. A process in accordance with claim 6 wherein said aromatic hydrocarbon solvent is toluene and the cationic surfactant comprises 80 percent methyldodecylbenzyl trimethylammonium chloride and 20 percent methyldodecylxylene-bis-(trimethylammonium chloride).

* * * * *